US006835107B2

(12) United States Patent
Wu

(10) Patent No.: US 6,835,107 B2
(45) Date of Patent: Dec. 28, 2004

(54) ELECTRICAL CONNECTOR

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 20 days.

(21) Appl. No.: 10/355,549

(22) Filed: Jan. 31, 2003

(65) Prior Publication Data

US 2004/0152368 A1 Aug. 5, 2004

(51) Int. Cl.[7] ..... H01R 13/04
(52) U.S. Cl. ..... 439/856; 439/733.1
(58) Field of Search ..... 439/733.1, 290, 439/291, 862, 856, 857, 682, 701

(56) References Cited

U.S. PATENT DOCUMENTS

| | | | | |
|---|---|---|---|---|
| 3,833,879 A | | 9/1974 | Aidn et al. | |
| 3,945,710 A | * | 3/1976 | Gartland, Jr. | 439/857 |
| 4,175,821 A | | 11/1979 | Hunter | |
| 4,607,907 A | | 8/1986 | Bogursky | |
| 4,735,588 A | | 4/1988 | Bird et al. | |
| 4,740,180 A | | 4/1988 | Harwath et al. | |
| 4,941,853 A | | 7/1990 | Harwath | |
| 5,290,181 A | | 3/1994 | Bixler et al. | |
| 5,558,542 A | | 9/1996 | O'Sullivan et al. | |
| 5,667,411 A | | 9/1997 | O'Sullivan et al. | |
| 5,692,928 A | | 12/1997 | Nelson et al. | |
| 5,807,142 A | | 9/1998 | O'Sullivan et al. | |
| 6,290,548 B1 | | 9/2001 | Yeh | |
| 6,322,403 B1 | * | 11/2001 | Lok et al. | 439/856 |
| 6,595,799 B2 | * | 7/2003 | Yao | 439/857 |

FOREIGN PATENT DOCUMENTS

| | | |
|---|---|---|
| TW | 454995 | 9/2001 |
| TW | 484754 | 4/2002 |

* cited by examiner

*Primary Examiner*—Renee Luebke
(74) *Attorney, Agent, or Firm*—Wei Te Chung

(57) ABSTRACT

An electrical connector (1) includes an insulative housing (20) and a number of electrical terminals (30). The insulative housing has a base portion (200) defining a number of passageways (203) and a mating portion (210) defining a receiving cavity (211) in communication with the passageways. Every two electrical terminals are received in one passageway and each electrical terminal has a contact portion (301) and a tab (303) extending in the receiving cavity.

9 Claims, 7 Drawing Sheets

ELECTRICAL CONNECTOR

BACKGROUND OF THE INVENTION

1. Field of the Invention

The present invention relates to the arts of electrical connectors, and particularly to an electrical connector comprising a plurality of electrical terminals.

2. Description of the Prior Art

U.S. Pat. No. 4,740,180 discloses a male terminal for an electrical connector and having a contact portion for electrically contacting with a pair of beams of a female terminal of a complementary electrical connector. The male terminal is formed with a lead-in portion twisted with respect to the contact portion to comply with configurations of the beams of the female terminal. The male terminal is not easily adaptable for miniaturization beyond a certain point, i.e., for reducing individual terminal size in order to produce denser arrays of terminal size in order to produce denser arrays of terminals in increasingly smaller packages. Furthermore, the solid lead-in portion of the male terminal has limited mating depth and does not generally permit applications in which sequential or staggered mating may be required. They may provide potential problems in some specific connector applications.

U.S. Pat. No. 5,290,181 discloses another male terminal including a contact portion and a splited lead-in portion for guiding a pair of spring arms of a female terminal to electrically contact with the contact portion. The male terminal is relatively difficult to manufacture since diverging beams of the lead-in portion of each male terminal extend in directions different from each other and different from the rest sections of the male terminal, thereby increasing the cost of the electrical connector using the same.

Therefore, an improved electrical connector is desired to overcome the disadvantages of the prior art.

SUMMARY OF THE INVENTION

A major object of the present invention is to provide an electrical connector comprising a plurality of easily adaptable and easily manufacturable electrical terminals.

An electrical connector in accordance with the present invention comprises an insulative housing and a plurality of electrical terminals. The insulative housing comprises a base portion defining a plurality of passageways and a mating portion extending from the base portion and defining a receiving cavity in communication with the passageways. Every two electrical terminals are inserted through one of the passageways and each comprises a retention portion retained to the base portion, a tail portion extending rearwardly from the retention portion beyond the insulative housing, a contact portion extending forwardly from the retention portion into the receiving cavity and a tab extending forwardly from the contact portion in the receiving cavity. The retention portions, the tail portions and the contact portions of the every two electrical terminals are vertically stacked. The tabs of the every two electrical terminals are laterally offset from each other and extend slantedly away from each other.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
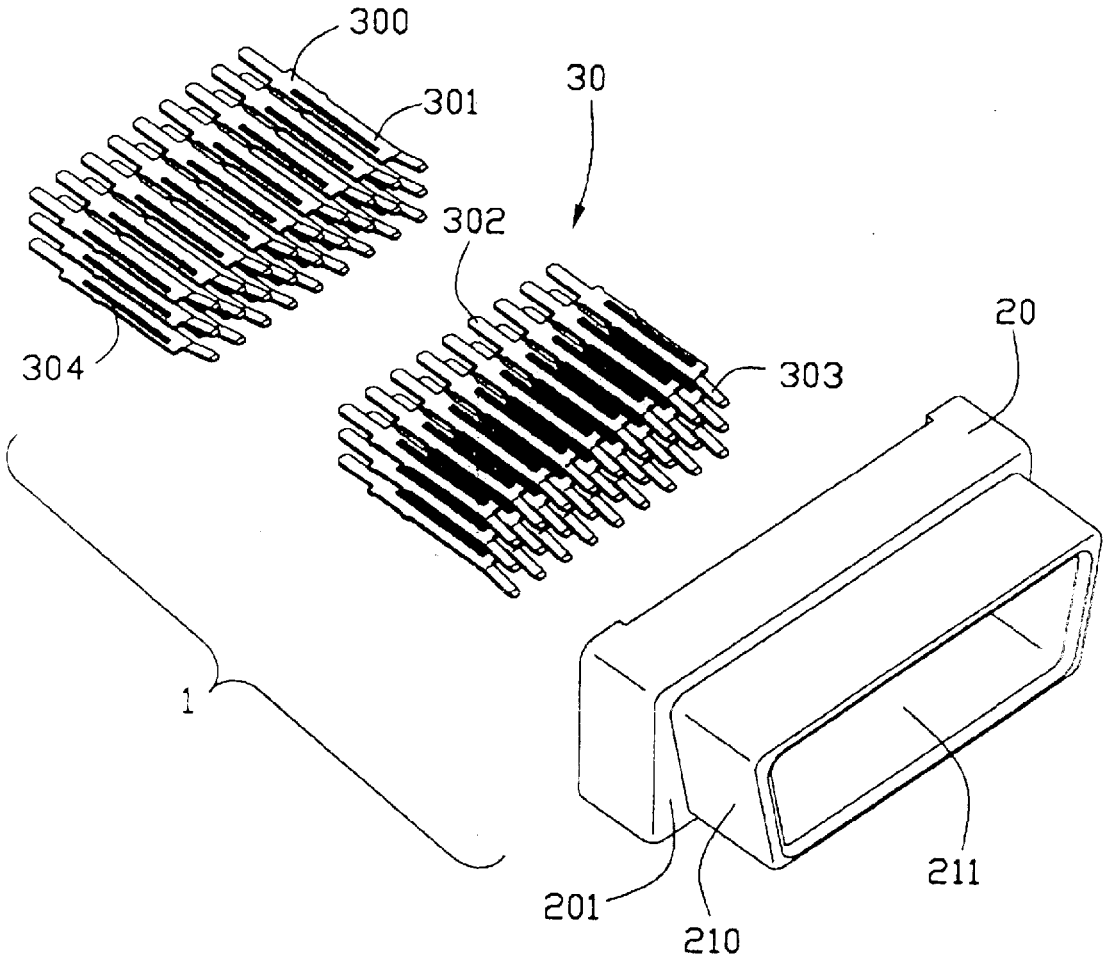
FIG. 1 is an exploded perspective view of an electrical connector in accordance with the present invention.
Figure 2:
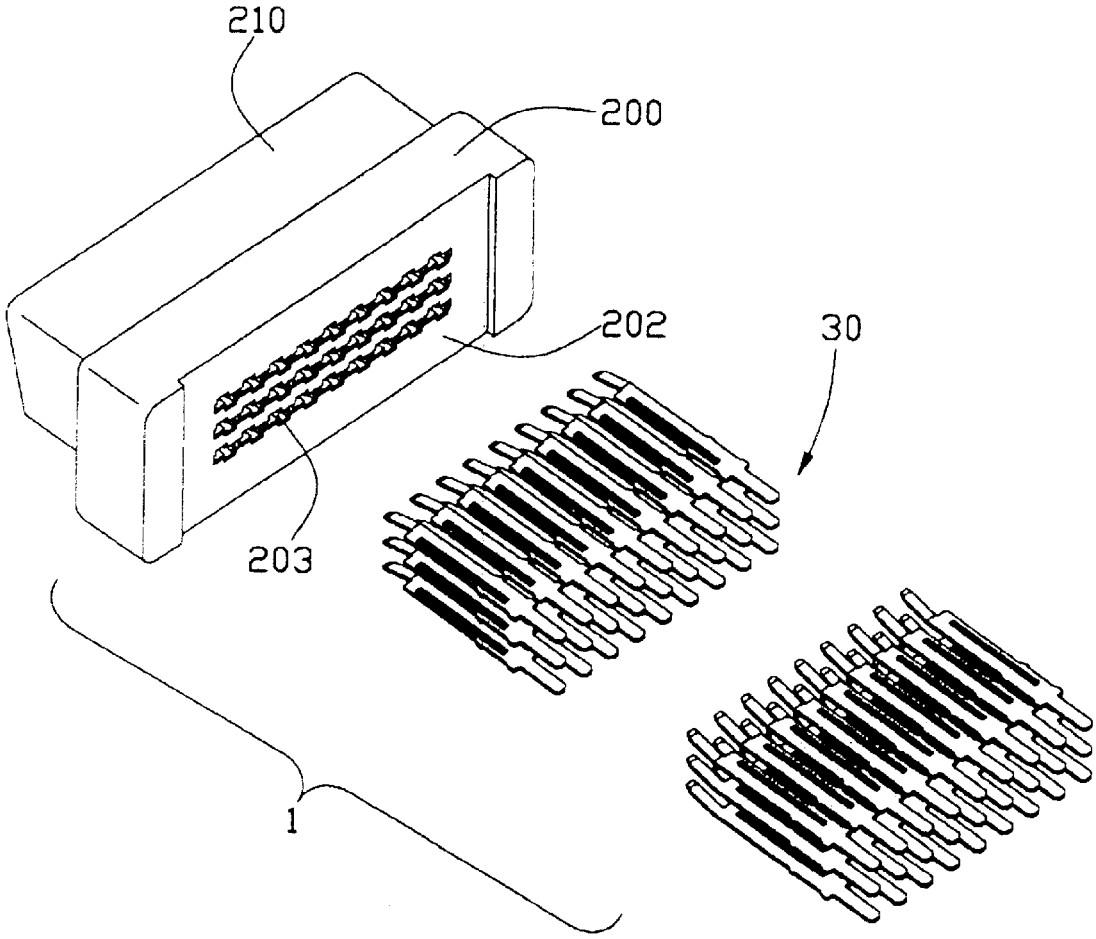
FIG. 2 is a view similar to FIG. 1 but taken from a different perspective.

Referring to FIGS. 1 and 2, an electrical connector 1 in accordance with the present invention comprises an insulative housing 20 and a plurality of electrical terminals 30.

Figure 3:
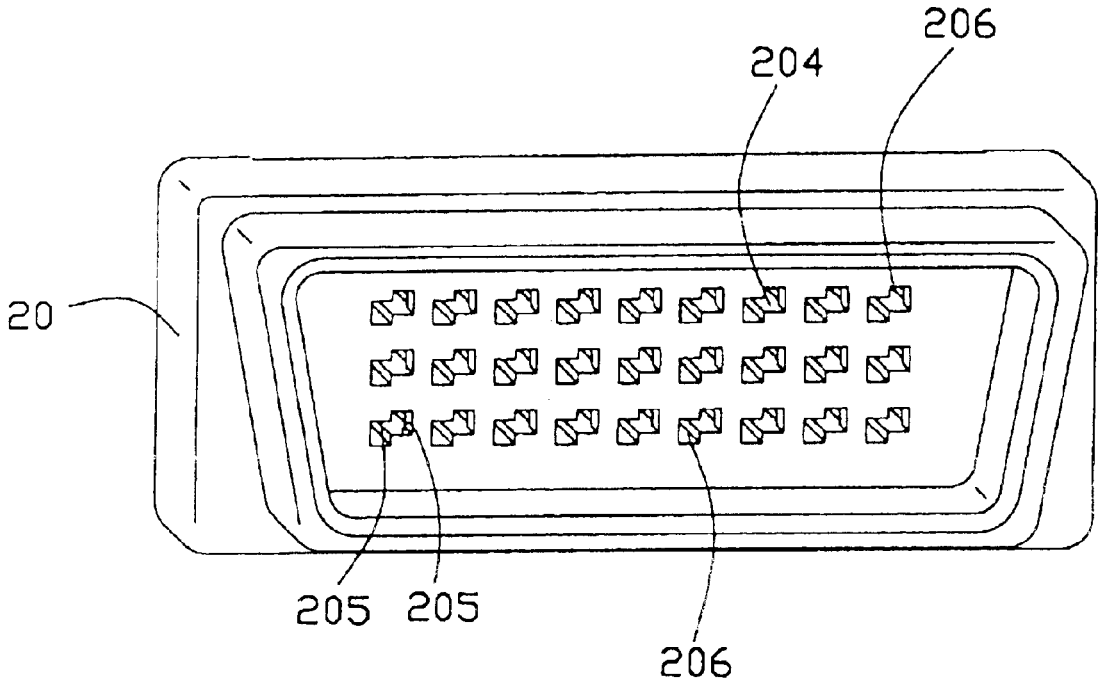
FIG. 3 is a perspective view of an insulative housing of the electrical connector of FIG. 1.
Figure 4:
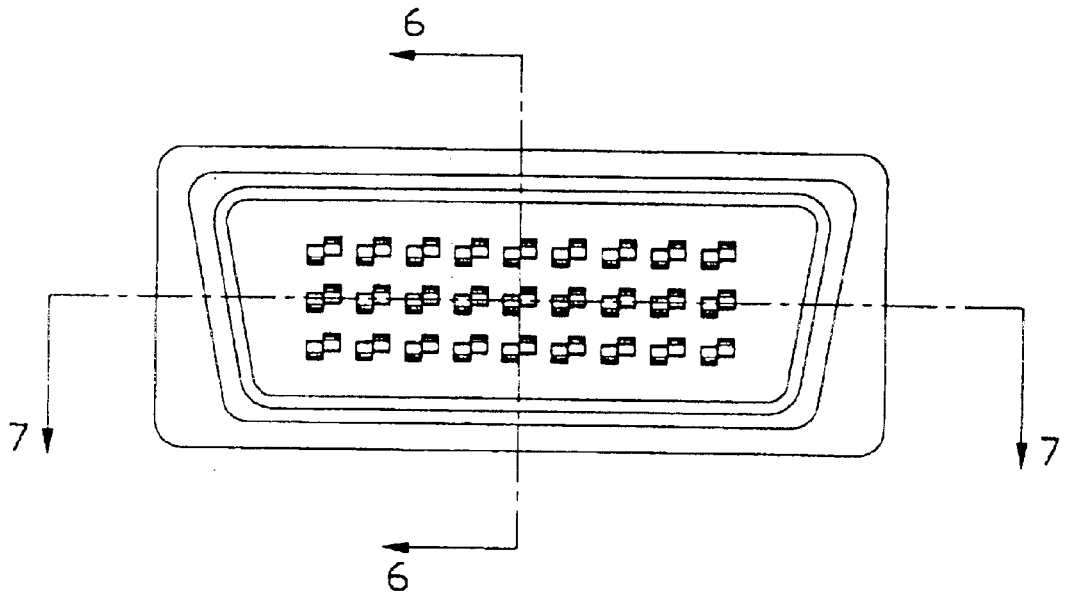
FIG. 4 is an assembled front planar view of the electrical connector of FIG. 1.
Figure 5:
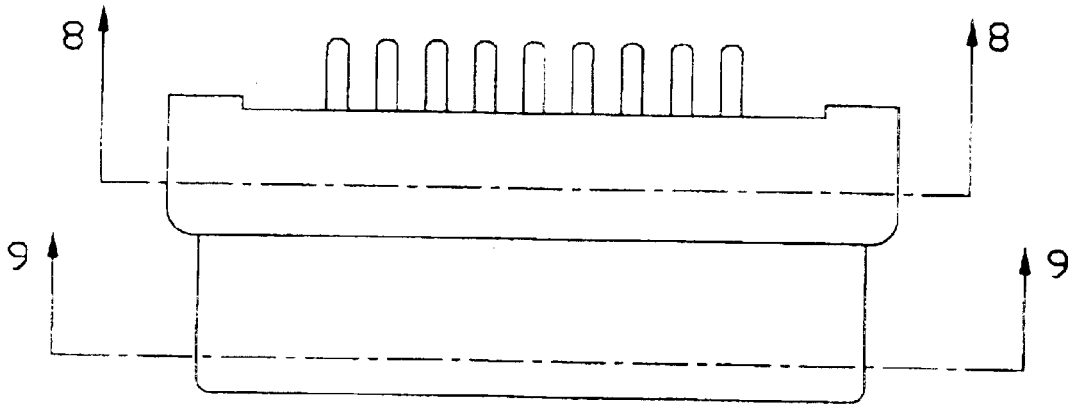
FIG. 5 is a top planar view of FIG. 4.
Figure 6:
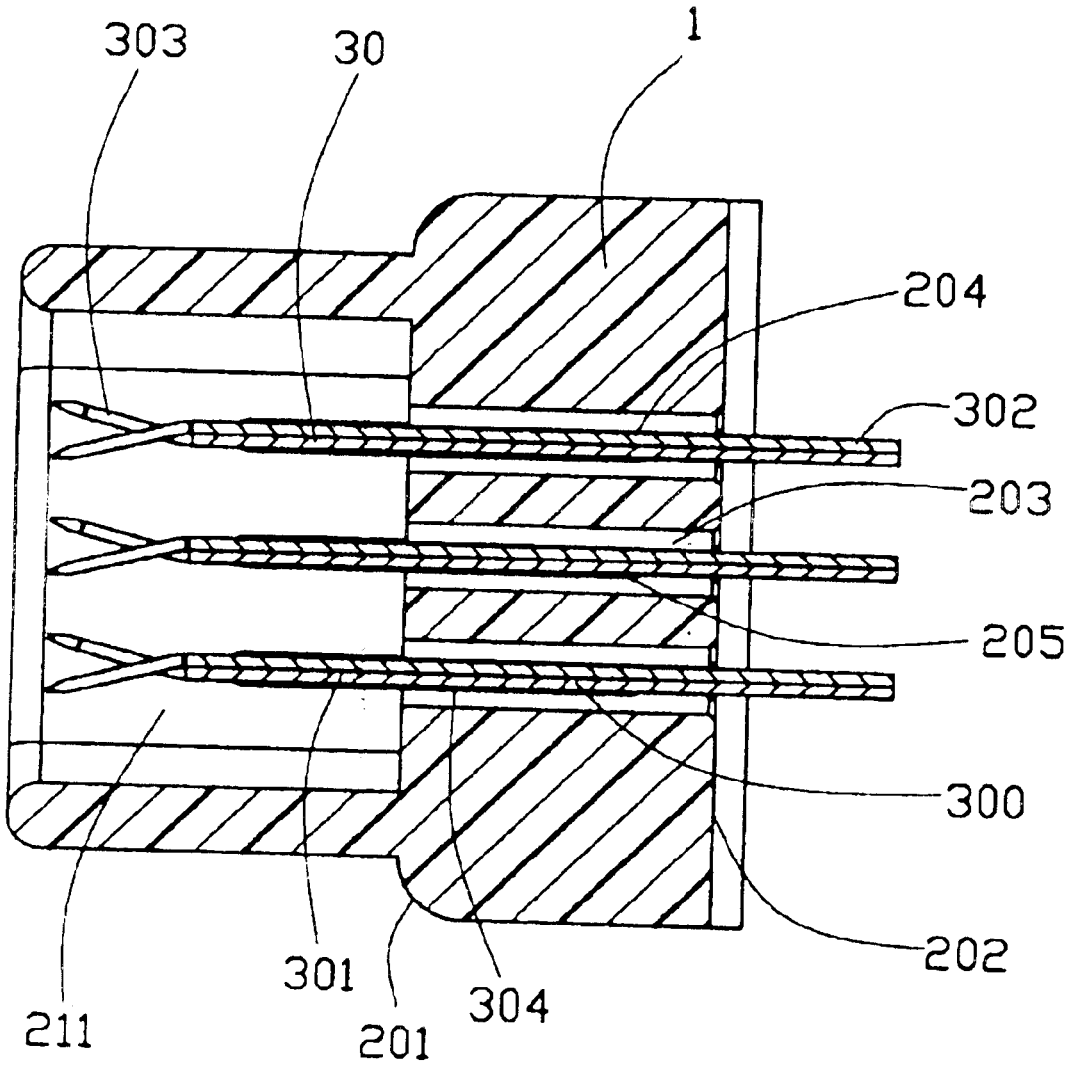
FIG. 6 is a cross-sectional view taken along line 6—6 of FIG. 4.
Figure 7:
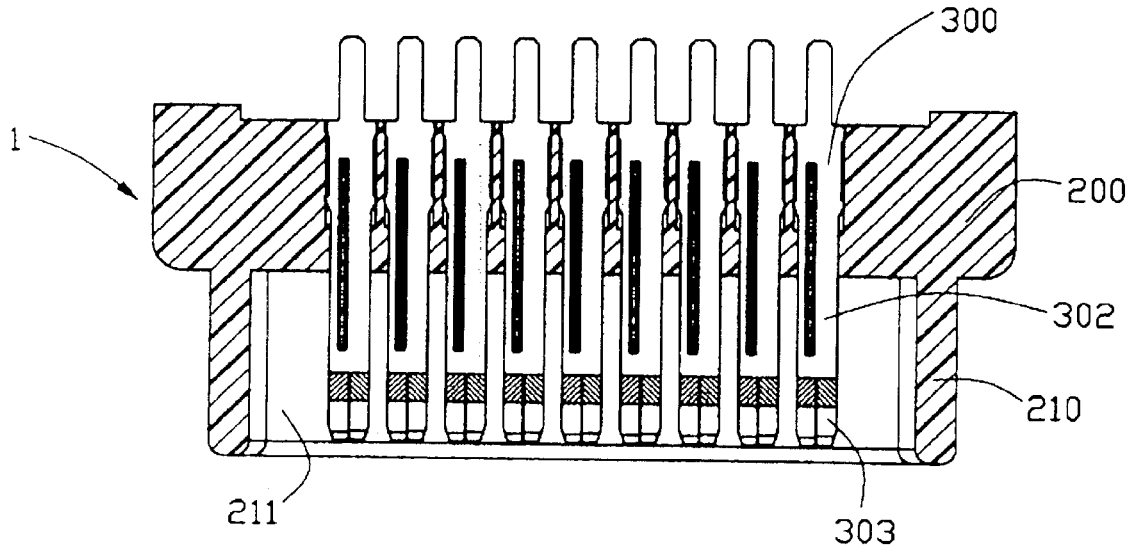
FIG. 7 is a cross-sectional view taken along line 7—7 of FIG. 4.
Figure 8:
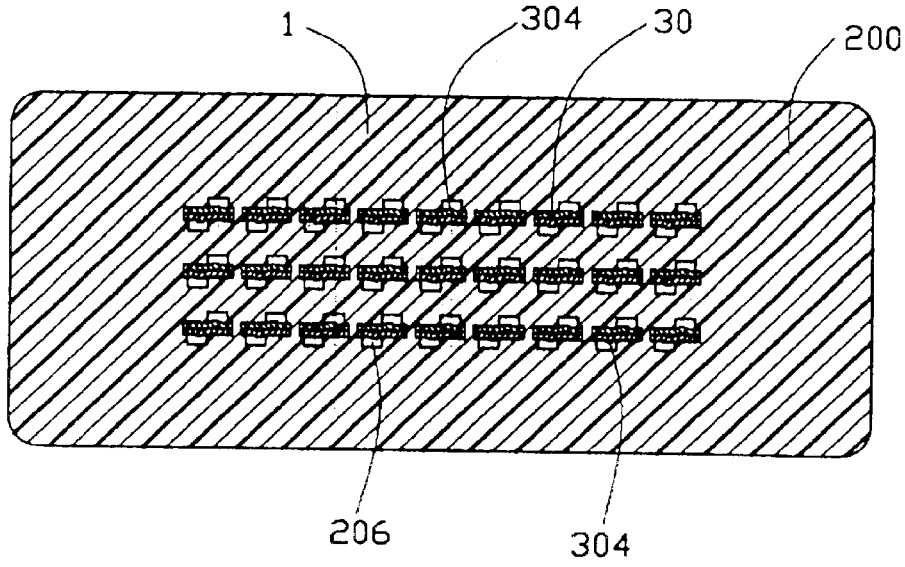
FIG. 8 is a cross-sectional view taken along line 8—8 of FIG. 5.
Figure 9:
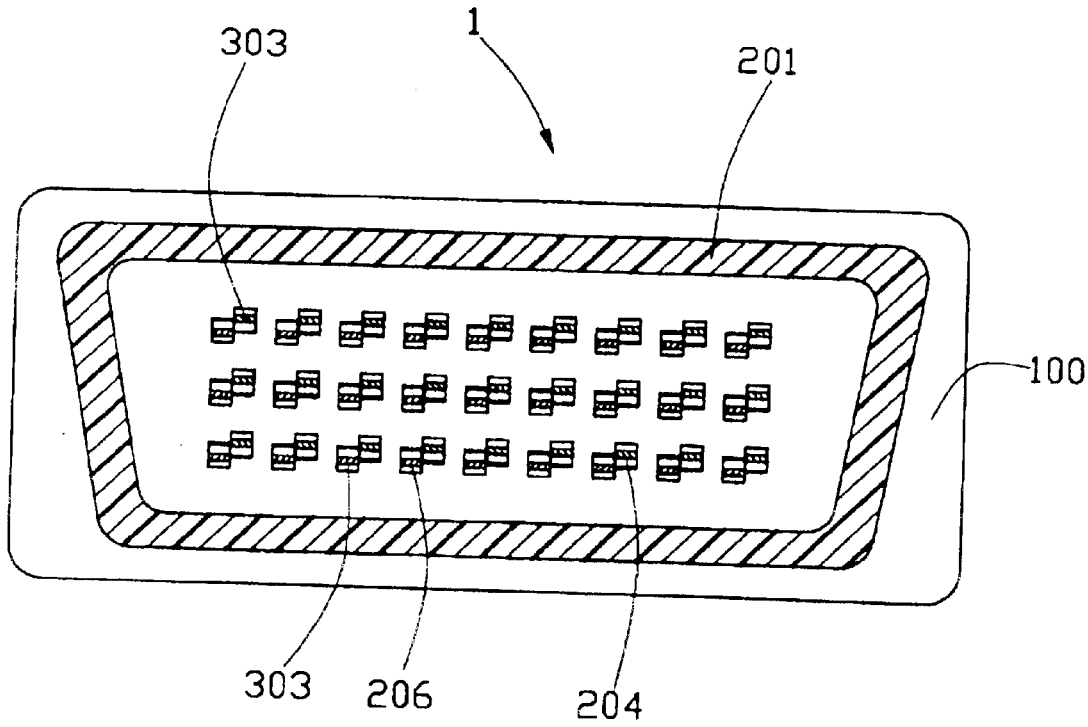
FIG. 9 is a cross-sectional view taken along line 9—9 of FIG. 5.

The insulative housing 20 comprises a rectangular base portion 200 and a D-shaped mating portion 210. The base portion 200 defines a mating face 201, engaging face 202 opposite to the mating face 201 and a plurality of passageways 203 extending through the mating and the engaging faces 201, 202. Referring also to FIG. 3, each of the passageways 203 comprises a receiving section 204 having a pair of opposing walls 205, and a pair of diverging sections 206 extending respectively outwardly from the opposing walls 205 of the receiving section 204 and communicating with the receiving section 204.

The mating portion 210 extends forwardly from the mating face 201 of the base portion 200 and defines a receiving cavity 211 in communication with the passageways 203 of the base portion 200.

The number of the electrical terminals 30 is twice the number of the passageways 203 of the base portion 200. Each electrical terminal 30 comprises a planar retention portion 300, a planar contact portion 301 extending forwardly from the retention portion 300, a planar tail portion 302 extending rearwardly from the retention portion 300, a tab 303 extending slantedly and forwardly from the contact portion 301, and a bump 304 formed on the retention and the contact portions 300, 301. The retention portion 300, the contact portion 301 and the tail portion 302 are coplanar with each other. The tab 303 defines an angle with respect to a plane defined by the retention portion 300, the contact portion 301 and the tail portion 302. The width of the tab 303 is smaller than the width of the contact portion 301 so that when two electrical terminals 30 are vertically stacked in a face-to-face fashion, the tabs 303 are laterally offset from each other. The electrical terminals 30 are manufactured simply by usual means known to persons skilled in the pertinent art.

Referring also to FIGS. 4–9, every two electrical terminals 30 are inserted into one corresponding passageway 203 of the insulative housing 20 with the tabs 303 thereof respectively extending through the diverging sections 206 of the passageway 203. The two electrical terminals 30 are arranged in such a way that the retention portions 300, the contact portions 301 and the tail portions 302 thereof are respectively vertically stacked in a face-to-face fashion and the tabs 303 are laterally offset from each other and extend vertically away from each other. The retention portions 300 are accommodated in the main sections 204 of the passageways 203 to retain the electrical terminals 30 to the insulative housing 20 with the walls 205 restricting the vertical movement of the electrical terminals 30.

The tail portions 302 of the electrical terminals 30 extend beyond the engaging face 202 of the base portion 200 of the insulative housing 20 and the contact portions 301 and the tabs 303 of the electrical terminals 30 extend beyond the mating face 201 to be received in the receiving cavity 211 of the insulative housing 20. The bumps 304 of the electrical terminals 30 increase the strength of the electrical terminals 30.

The tabs 303 of the upper ones of the every two stacked electrical terminals 30 are downwardly slanted while the tabs 303 of the lower ones of the every two stacked electrical terminals 30 are upwardly slanted.

In comparison with the prior art, the terminal has no so-called split portion, thus reducing force concentration effect. Additionally, when mated with a female connector as disclosed in a contemporaneously filed application having a title "LOW INSERTION FORCE ELECTRIAL CONNECTOR ASSEMBLY" having the same applicant and the same assignee with the instant application, the tab 303 of the terminal 30 can be supported by its own corresponding contact and retention, thus assuring reliable mating, in comparison with the prior art showing only one contact and retention portion shared by two split tabs.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing comprising a base portion and a mating portion extending from the base portion and defining a receiving cavity, the base portion defining a plurality of passageways in communication with the receiving cavity; and a plurality of discrete electrical terminals each comprising a retention portion retained to the base portion, a tail portion extending rearwardly from the retention portion beyond the insulative housing, a contact portion extending forwardly from the retention portion into the receiving cavity and a tab extending slantedly and forwardly from the contact portion in the receiving cavity, the retention portions of every two electrical terminals being received in one of the passageways of the base portion.

2. The electrical connector as claimed in claim 1, wherein the retention portion, the tail portion and the contact portion of each of the electrical terminals are coplanar with respect to each other.

3. The electrical connector as claimed in claim 2, wherein the tab defines an angle with respect to a plane defined by the retention portion, the tail portion and the contact portion of each of the electrical terminals.

4. The electrical connector as claimed in claim 1, wherein the retention portions, the tail portions, and the contact portions of the every two electrical terminals are vertically stacked.

5. The electrical connector as claimed in claim 4, wherein the tabs of the every two electrical terminals extend away from each other.

6. The electrical connector as claimed in claim 4, wherein the tabs of the every two electrical terminals are laterally offset from each other.

7. The electrical connector as claimed in claim 6, wherein the tabs of the every two electrical terminals extend vertically away from each other.

8. An electrical connector comprising:

an insulative housing defining a receiving cavity; and a plurality of electrical terminals arranged in pairs, each pair received within the receiving cavity, the corresponding two terminals of each pair abutting against each other, each of said two terminals including a plate defining a retention portion retained to the insulative housing and an outwardly facing contact surface away from the other and opposite to the corresponding outwardly facing contact surface of said other, a tab extending forwardly from a front edge of said plate; wherein the tab of each of the two terminals of said each pair is laterally offset from that of the other of said two terminals, and obliquely extends toward the other of said two terminals, a combined thickness of the plates of the two terminals of said each pair is twice a thickness of each of said tabs.

9. An electrical connector comprising:

an insulative housing defining a receiving cavity; and a plurality of electrical terminals arranged in pairs, each pair received within the receiving cavity, the corresponding two terminals of each pair abutting against each other in a direction, each of said two terminals including a plate defining a retention portion and an outwardly facing contact surface away from the other and opposite to the corresponding outwardly facing contact surface of said other, a tab extending forwardly from a front edge of said plate; wherein the tab of each of the two terminals of said each pair is laterally offset from the tab of the other of said two terminals, and obliquely extends toward and beyond the other of said two terminals in said direction, a combined thickness of the plates of the two terminals of said each pair is twice a thickness of each of said tabs.

* * * * *